US007857861B2

(12) United States Patent
Komeda et al.

(10) Patent No.: US 7,857,861 B2
(45) Date of Patent: Dec. 28, 2010

(54) HYDROPHILIZING AGENT AND HYDROPHILIZED FIBER TREATED THEREWITH

(75) Inventors: Haruhiko Komeda, Yao (JP); Setsuo Kita, Yao (JP); Hidetoshi Kitaguchi, Yao (JP); Kazuki Ito, Yao (JP); Yoshiharu Fujimoto, Yao (JP)

(73) Assignee: Matsumoto Yushi-Seiyaku Co., Ltd., Yao-Shi (JP)

( * ) Notice: Subject to any disclaimer, the term of this patent is extended or adjusted under 35 U.S.C. 154(b) by 924 days.

(21) Appl. No.: 11/672,528

(22) Filed: Feb. 8, 2007

(65) Prior Publication Data

US 2007/0192965 A1 Aug. 23, 2007

(30) Foreign Application Priority Data

Feb. 17, 2006 (JP) ..... 2006-073496

(51) Int. Cl.

| | |
|---|---|
| ***C11D 3/00*** | (2006.01) |
| ***D06M 15/423*** | (2006.01) |
| ***D06M 13/127*** | (2006.01) |
| ***D01F 9/22*** | (2006.01) |
| ***C08J 7/12*** | (2006.01) |
| ***D06P 1/673*** | (2006.01) |

(52) U.S. Cl. ..... 8/115.51; 8/115.6; 8/115.54; 8/115.56; 8/115.64; 8/115.65

(58) Field of Classification Search ..... 8/115.51, 8/115.6, 115.54, 115.56, 115.64, 115.65
See application file for complete search history.

(56) References Cited

U.S. PATENT DOCUMENTS

| | | | | |
|---|---|---|---|---|
| 3,074,815 | A * | 1/1963 | Lee et al. | 442/97 |
| 3,967,623 | A * | 7/1976 | Butterworth et al. | 604/370 |
| 5,190,997 | A * | 3/1993 | Lindemann et al. | 524/44 |
| 6,736,858 | B2 | 5/2004 | Kita et al. | |
| 2003/0153227 | A1 * | 8/2003 | Nihlstrand et al. | 442/118 |
| 2007/0191803 | A1 * | 8/2007 | Diehl et al. | 604/385.17 |

FOREIGN PATENT DOCUMENTS

| | | | |
|---|---|---|---|
| JP | 60-215870 | A | 10/1985 |
| JP | 63-14081 | B2 | 3/1988 |
| JP | 4-82961 | A | 3/1992 |
| JP | 2000-170076 | A | 6/2000 |
| JP | 2002-161474 | A | 6/2002 |
| JP | 2002-161477 | A | 6/2002 |
| JP | 2003-239172 | A | 8/2003 |
| JP | 2004250855 | A * | 9/2004 |

* cited by examiner

*Primary Examiner*—Lorna M Douyon
*Assistant Examiner*—Tanisha Diggs
(74) *Attorney, Agent, or Firm*—Global IP Counselors, LLP

(57) ABSTRACT

The hydrophilizing agent contains (a) a cationized compound of a (poly) amine, (b) an ester, (c) a dialkyl sulfosuccinate salt, (d) an alkylphosphate salt, (e) at least one glycine derivative selected from the group consisting of trialkyl glycine derivatives and (alkylamide alkyl) dialkyl glycine derivatives, and (f) a polyoxyalkylene-modified silicone; wherein the ratio of the component (a) ranges from 10 to 40 wt. %, the ratio of the component (b) ranges from 10 to 40 wt. %, the ratio of the component (c) ranges from 1 to 40 wt. %, the ratio of the component (d) ranges from 10 to 60 wt. %, the ratio of the component (e) ranges from 10 to 40 wt. %, and the ratio of the component (f) ranges from 1 to 20 wt. % of the hydrophilizing agent.

7 Claims, No Drawings

HYDROPHILIZING AGENT AND HYDROPHILIZED FIBER TREATED THEREWITH

CROSS-REFERENCE TO RELATED APPLICATIONS

This application claims priority to Japanese Patent Application No. 2006-073496. The entire disclosure of Japanese Patent Application No. 2006-073496 is hereby incorporated herein by reference.

BACKGROUND OF THE INVENTION

A. Technical Field

The present invention relates to a hydrophilizing agent and a hydrophilized fiber treated with the agent.

Specifically, the present invention relates to a hydrophilizing agent which is ideal for fibers that are to be processed into nonwoven fabrics and formed into fiber products such as topsheets for disposable diapers and sanitary napkins, and also relates to hydrophilized fibers treated with the agent. More specifically, the present invention relates to a hydrophilizing agent which not only imparts hydrophilicity, but also prevents a phenomenon referred to as "wet back", i.e., rewetting a wearers' skin by the reverse flow of urine or body fluid through topsheet after it is absorbed through the topsheet, and improves the liquid absorbing performance and durable liquid permeability of the topsheet; and also relates to a hydrophilized fiber treated with the agent.

B. Background Art

Absorbent articles such as disposable diapers and sanitary items usually comprise three components: a topsheet, a water-repellent back sheet, and a core of pulp and/or absorbent polymers enclosed between the topsheet and the backsheet; wherein the topsheet is manufactured by imparting liquid permeability (hydrophilicity) to nonwoven fabrics formed primarily of hydrophobic fibers, such as polyolefin fiber or polyester fiber including triacetate fiber. The topsheet is usually treated with a hydrophilizing agent so as to make the topsheet hydrophilic.

When urine or body fluid is absorbed into an absorbent core through the topsheet, the topsheet is required to have excellent liquid permeability, in other words, the liquid must be absorbed into the internal absorbent core completely through the topsheet in a short amount of time, for the purpose of minimizing a wet feel on the topsheet surface. In addition, the liquid absorbed in the absorbent core must not flow back to the topsheet surface. A hydrophilizing agent, which is easily flushed off from the topsheet after one or two times of liquid absorption and thus result in a drastic decrease in the topsheet's liquid permeability is not preferable, because absorbent articles containing this type of topsheet should be changed frequently. Thus, the hydrophilizing agent must attain durable liquid permeability of the topsheet, and retain the durable liquid permeability of the topsheet for a long period of time, in other words, minimize the time-dependent deterioration of the durable liquid permeability of the topsheet.

For smooth manufacturing of nonwoven fabric, fibers treated with the hydrophilizing agent must have sufficient antistaticity and good processability in carding in order to be processed into a uniform web without fiber wrapping onto a card cylinder.

For the wearing comfort of absorbent articles, they must retain excellent liquid permeability with minimum wet back, and also retain sufficient hydrophilicity (durable liquid permeability) after repeated liquid permeation. It is well known that those performances are improved with a hydrophilizing agent. For example, Patent Reference 1 proposes a method for treating fiber with a potassium $C_{12-22}$ linear alkyl phosphate. Patent Reference 2 proposes a hydrophilizing agent formulated by blending a $C_{10-30}$ alkyl phosphate salt with a $C_{10-30}$ betaine compound, a sulfate salt, or a sulfonate salt. Patent Reference 3 proposes a method in which an alkyl phosphate salt is blended with a polyether-modified silicone. Patent Reference 4 proposes a method including the step of blending two betaine compounds to an alkyl phosphate salt.

Patent Reference 5 proposes a method including the step of blending a cationized compound of an acylated polyamine, an alkylphosphate salt, a trialkyl glycine derivative, and a polyoxyalkylene-modified silicone to a polyoxyalkylene fatty acid amide. Patent Reference 6 proposes a method including the step of treating fiber with a blend of an alkylphosphate salt, a trialkyl glycine derivative, a polyoxyalkylene-modified silicone, and an alkoxylated ricinoleic compound.

[Patent Reference 1] JP B 63-14081
[Patent Reference 2] JP A 60-215870
[Patent Reference 3] JP A 4-82961
[Patent Reference 4] JP A 2000-170076
[Patent Reference 5] JP A 2002-161474
[Patent Reference 6] JPA2002-161477

The methods proposed in these references contain both advantages and disadvantages with respect to the required surface properties of nonwoven fabrics, and none of those methods sufficiently prevents wet back. A hydrophilic agent is preferable for improving liquid permeability, while a hydrophobic agent is preferable for minimizing wet back. Such a situation suggests that nonwoven surface properties are not only influenced by the hydrophilic and hydrophobic properties of the components in a hydrophilizing agent, but also influenced by the chemical structure thereof, the balance between hydrophilicity and hydrophobicity of the components thereof, and the interaction between the components thereof. It has been difficult for one hydrophilizing agent to attain both improved liquid permeability and wet back prevention simultaneously, and minimize the time-dependent deterioration of durable liquid permeability. Thus, wet back has been prevented by some type of means for modifying the structure of absorbent articles, such as forming a double-layered nonwoven topsheet comprising nonwoven fabrics having different hydrophilic properties, or adjusting the arrangement and amount of pulp and/or absorbent polymers.

In view of the above, it will be apparent to those skilled in the art from this disclosure that there exists a need for an improved hydrophilizing agent, which functions to decrease the amount of wet-back liquid without modifying the structure of absorbent articles in which it is used, and imparts good processability in carding to fibers and superior durable liquid permeability to a fiber assembly, as well as a need for improved hydrophilized fiber treated with the agent.

SUMMARY OF THE INVENTION

The hydrophilizing agent of the present invention comprises (a) a cationized compound of a (poly) amine having a polyoxyalkylene group and an acyl group, (b) an ester prepared by capping, with a fatty acid, at least one hydroxyl group in a condensate of a dicarboxylic acid and a hydroxy fatty acid polyhydric alcohol ester containing a polyoxyalkylene group, (c) a dialkyl sulfosuccinate salt, (d) an alkylphosphate salt, (e) at least one glycine derivative selected from the group consisting of trialkyl glycine derivatives and (alkylamide alkyl) dialkyl glycine derivatives, and (f) a polyoxyalkylene-modified silicone; wherein the component (a) constitutes 10 to 40 wt. %, the component (b) constitutes 10 to 40 wt. %, the component (c) constitutes 1 to 40 wt. %, the component (d) constitutes 10 to 60 wt. %, the component (e) constitutes 10 to 40 wt. %, and the component (f) constitutes 1 to 20 wt. % in the total amount of the hydrophilizing agent. The hydrophilizing agent of the present invention which further satisfies the following requirements (1) to (6) is preferable.

(1) In the component (a), the polyoxyalkylene group comprises 2 to 20 ethylene oxide units, the acyl group contains 16 to 28 carbon atoms, and the (poly) amine is derived from polyethylene polyamine.

(2) In the component (b), the hydroxy fatty acid polyhydric alcohol ester containing a polyoxyalkylene group is an alkylene-oxide adduct of an ester of a $C_{6-22}$ hydroxy fatty acid and a polyhydric alcohol, the dicarboxylic acid contains 2 to 10 carbon atoms, and the fatty acid contains 10 to 22 carbon atoms.

(3) The component (c) contains a $C_{6-18}$ alkyl group, and is a sodium salt and/or a potassium salt.

(4) The component (d) contains a $C_{6-22}$ alkyl group, and is at least one salt selected from the group consisting of potassium salts, sodium salts, $C_{1-9}$ alkyl amine salts, and ammonium salts.

(5) The component (e) is a compound represented by the following Formula 1.

[Formula 1]

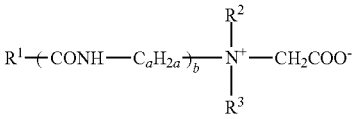

(1)

where $R^1$ is a $C_{7-22}$ hydrocarbon group, a is an integer ranging from 1 to 3, b is 0 or 1, and $R^2$ and $R^3$ are $C_{1-3}$ hydrocarbon groups.

(6) The molecular weight of the component (f) ranges from 1,000 to 100,000, and polyoxyethylene constitutes at least 20 wt. % of the polyoxyalkylene.

The hydrophilized fiber of the present invention comprises fiber and the above-mentioned hydrophilizing agent applied to the fiber, and the hydrophilizing agent constitutes to 0.1 to 2 wt. % of the hydrophilized fiber.

These and other objects, features, aspects and advantages of the present invention will become apparent to those skilled in the art from the following detailed description, which, taken in conjunction with the annexed drawings, discloses a preferred embodiment of the present invention.

DETAILED DESCRIPTION OF THE INVENTION

The hydrophilizing agent of the present invention contains the six essential components described below in the ratios given in the parentheses, respectively.

Component (a): a cationized compound of a (poly) amine having a polyoxyalkylene group and an acyl group (10 to 40 wt. % of the hydrophilizing agent)

Component (b): an ester prepared by capping, with a fatty acid, at least one hydroxyl group of the condensate of a dicarboxylic acid and a hydroxy fatty acid polyhydric alcohol ester containing a polyoxyalkylene group (10 to 40 wt. % of the hydrophilizing agent)

Component (c): dialkyl sulfosuccinate salt (1 to 40 wt. % of the hydrophilizing agent)

Component (d): alkylphosphate salt (10 to 60 wt. % of the hydrophilizing agent)

Component (e): at least one glycine derivative selected from the group consisting of trialkyl glycine derivatives and (alkylamide alkyl) dialkyl glycine derivatives (10 to 40 wt. % of the hydrophilizing agent)

Component (f): polyoxyalkylene-modified silicone (1 to 20 wt. % of the hydrophilizing agent)

A detailed description of each of the components is given below.

[Component (a)]

The component (a) is a cationized compound of a (poly) amine having a polyoxyalkylene group and an acyl group. The component (a) functions to decrease the amount of wet-back liquid, and to impart superior durable liquid permeability with minimum time-dependent deterioration to the fiber assembly.

The (poly) amine may be polyamines having at least two free amino groups, such as diamines, triamines, and tetramines, and may be monoamines having one free amino group.

The polyoxyalkylene group is directly bonded to the nitrogen atom in the (poly) amine. The polyoxyalkylene group may also be described as being bonded to at least one (N-substituted) amino group contained in the raw polyamine mentioned below.

The polyoxyalkylene group in the component (a) includes, for example, polyoxyethylene groups, polyoxypropylene groups, polyoxyethylene-oxypropylene groups, and polyoxybutylene groups. Among those, polyoxyethylene groups and polyoxyethylene-oxypropylene groups are preferable. A polyoxyalkylene group comprising two or more variants of alkylene oxide units may be in the form of either block or random addition.

The number of polyoxyalkylene groups contained in the (poly) amine is not specifically restricted, and the total number of alkylene oxide units forming a polyoxyalkylene group preferably ranges from 2 to 20, more preferably from 5 to 15, most preferably from 9 to 12. A number over 20 will result in decreased durable liquid permeability and time-dependent deterioration of the durable liquid permeability, and sometimes lead to an increased amount of wet-back liquid. When the polyoxyalkylene group comprises a polyoxyethylene-oxypropylene group, the preferable number of ethylene oxide units is equal to or greater than the number of propylene oxide units.

The acyl group is bonded directly to the nitrogen atom in the (poly) amine to form an amide group. The acyl group may be described as being bonded to at least one amino group in the raw polyamine mentioned below to form an amide group.

The carbon number of the acyl group preferably ranges from 16 to 28, more preferably from 16 to 22. An acyl group having less than 16 carbon atoms will result in excessive hydrophilicity of the fiber assembly, which increases the amount of wet-back liquid, and sometimes decreases the durability of the liquid permeability of the fiber assembly. On the other hand, an acyl group having more than 28 carbon atoms will sometimes make the component (a) hard to handle. The acyl group includes groups formed by removing hydroxyl groups from saturated or unsaturated fatty acids such as oleic acid, stearic acid, and behenic acid.

The number of acyl groups contained in the (poly) amine is not specifically restricted, and ranges preferably from 1 to 3. The number of acyl groups greater than 3 may decrease the water solubility of the resultant hydrophilizing agent.

The cationized compound is a reaction product of the above-mentioned (poly) amine and an alkylating reagent. The alkylating reagent is not specifically restricted, and it includes, for example, methyl chloride, methyl bromide, benzyl chloride, long-chain alkyl chloride, epichlorohydrin, dimethyl sulfate, diethyl sulfate, and trimethyl phosphate.

The (poly) amine is produced, for example, by reacting a monoalkyl amide (poly) amine, dialkyl amide (poly) amine, or the like, with alkylene oxides. The monoalkyl amide (poly) amine, dialkyl amide (poly) amine, or the like is obtained by reacting the saturated or unsaturated fatty acid and the raw polyamine mentioned above.

The raw polyamines are polyalkylene polyamines such as polyethylene polyamines (e.g., ethylene diamine, diethylene triamine, and triethylene tetramine), polypropylene polyamines (e.g., propylene diamine, dipropylene triamine, and tripropylene tetramine), and polybutylene polyamines (e.g., butylene diamine and dibutylene triamine). The number of carbon atoms contained in the polyalkylene polyamines is not specifically restricted, and preferably ranges from 2 to 4.

The raw polyamine may be polyamines obtained by substituting the hydrogen atoms of amino or imino groups with alkyl groups or hydroxyethyl groups, for example, alkyl polyalkylene polyamines such as ethyl diethylene triamine.

The alkylene oxide includes, for example, the alkylene oxides mentioned in the following description of component (b). Two or more variants of alkylene oxides may be combined, and the combination of ethylene oxide and propylene oxide is preferable. A combination wherein a greater number of ethylene oxide is combined with a smaller number of propylene oxide is further preferable.

The (poly) amine may be described as an amine having at least one alkylamide group and at least one polyoxyalkylene group directly bonded to a nitrogen atom in its molecule. The cationized compound of the (poly) amine may be described as a quaternary ammonium salt having at least one alkylamide group and at least one polyoxyalkylene group directly bonded to a nitrogen atom in its molecule. In such descriptions, a group obtained by removing amine-derived moiety from the alkylamide group corresponds to the acyl group.

The cationized compound of the (poly) amine, i.e., the component (a), may be represented by the following formula (2).

[Formula 2]

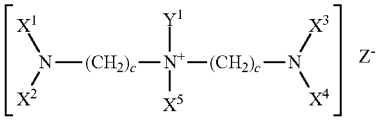

(2)

where c is an integer ranging from 2 to 4; each of $X^1$ to $X^5$ is a hydrogen atom, $R^4CO$—($R^4$ being a $C_{15-27}$ hydrocarbon group), or $-(A^1O)_d$—H ($A^1$ being a $C_{1-5}$ alkylene group, and d being an integer ranging from 2 to 20), wherein at least one of $X^1$ to $X^5$ is each $R^4CO$— and $-(A^1O)_d$—H, and each of $X^1$ and $X^2$, or each of $X^3$ and $X^4$ is not simultaneously a $R^4CO$—; a plurality of $-(A^1O)_d$—H need not always contain the same number of alkylene oxide units and the total number of the alkylene oxide units ranges from 2 to 20; and $Y^1$ and Z are groups derived from an alkylating agent ($Y^1$-Z).

The alkylating agent mentioned in the description of the above formula (2) includes the alkylating agents mentioned in the description of the above-mentioned cationized compounds.

The component (a) preferably constitutes 10 to 40 wt. % of the hydrophilizing agent, more preferably 15 to 35 wt. %. A ratio of the component (a) lower than 10 wt. % may result in decreased durable liquid permeability of fiber assembly and an increased amount of wet-back liquid. On the other hand, a ratio of the component (a) higher than 40 wt. % will result in increased viscosity of the agent and its solution, and may cause difficulty in handling.

The hydrophilizing agent of the present invention is also effective to impart durable liquid permeability with minimum time-dependent deterioration to a fiber assembly owing to the component (a).

[Component (b)]

The component (b) is an ester obtained by capping, with a fatty acid, at least one hydroxyl group in the condensate of a dicarboxylic acid and a hydroxy fatty acid polyhydric alcohol ester containing a polyoxyalkylene group (hereinafter sometimes referred to as polyhydroxy ester). The component (b) supplements the durable liquid permeability of the fiber assembly and decreases the amount of wet-back liquid.

The polyhydroxy ester is an ester of a hydroxy fatty acid containing a polyoxyalkylene group and a polyhydric alcohol, and two or more (preferably all) of the hydroxyl groups in the polyhydric alcohol are esterified. Thus, the hydroxy fatty acid polyhydric alcohol ester containing a polyoxyalkylene group contains a plurality of hydroxyl groups.

The hydroxy fatty acid containing a polyoxyalkylene group has a structure in which the polyoxyalkylene group is bonded to the principal chain of the fatty acid through an oxygen atom, and the other end of the polyoxyalkylene group, which is not bonded to the principal chain of the fatty acid, is a hydroxyl group.

The polyhydroxy ester includes, for example, an alkylene oxide adduct of an ester of $C_{6-22}$ hydroxy fatty acid and a polyhydric alcohol. A hydroxy fatty acid having less than 6 carbon atoms will increase the hydrophilicity of the agent, while a hydroxy fatty acid having more than 22 carbon atoms will increase the hydrophobicity of the agent. In both cases, the resultant component has poor compatibility with other components in the agent, and may not attain sufficiently durable liquid permeability of the fiber assembly.

The $C_{6-22}$ hydroxy fatty acid includes, for example, ricinoleic acid, 12-hydroxy stearic acid, and salicylic acid; and ricinoleic acid and 12-hydroxy stearic acid are preferable.

The polyhydric alcohol includes, for example, ethylene glycol, glycerin, sorbitan, and trimethylol propane; and glycerin is preferable. The alkylene oxide includes $C_{2-4}$ alkylene oxides such as ethylene oxide, propylene oxide, and butylene oxide.

The number of alkylene oxide units to be added to one hydroxyl group contained in the above-mentioned ester ranges preferably up to 80, more preferably from 5 to 30. A number greater than 80 is not preferable because it may result in an increased amount of wet-back liquid. For attaining superior durable liquid permeability of fiber assembly, it is essential to balance the hydrophilic groups and hydrophobic groups. For that purpose, the number of the alkylene oxide unit to be added to one molecule of the ester ranges preferably from 5 to 150, more preferably from 10 to 80. Ethylene oxide preferably constitutes 50 molar % or more of the alkylene oxide, and more preferably 80 molar % or more. A ratio of the ethylene oxide below 50 molar % results in increased hydrophobicity of the agent, and may not attain sufficient durable liquid permeability of the fiber assembly.

The polyhydroxy ester is produced, for example, by esterifying a polyhydric alcohol and hydroxy fatty acid (hydroxy monocarboxylic acid) under normal conditions, and by adding alkylene oxides to the resultant ester in an addition reaction. The polyhydroxy ester is preferably obtained by adding alkylene oxides to the esters of natural fats and oils such as castor oil, and the esters of hydrogenated natural fats and oils such as hydrogenated castor oil.

The component (b) is an ester obtained by capping, with fatty acid, at least one hydroxyl group of the condensate of a polyhydroxy ester and a dicarboxylic acid. As described above, the polyhydroxy ester contains hydroxyl groups. The major component of the condensate is, for example, a compound produced in the condensation-dehydration reaction of two molecules of a polyhydroxy ester and one molecule of a dicarboxylic acid. The structure of the major component, i.e., the condensate (hereinafter sometimes referred to as the condensate A) is represented as X—Y—X', where X and X' (X and X' may be the same) are polyhydroxy ester moiety, while Y is dicarboxylic acid moiety. The X—Y bond and X'—Y bond are the ester bonds formed in the reaction between the hydroxyl group of the polyhydroxy ester and the carboxyl group of the dicarboxylic acid.

The component (b) is an ester obtained by capping, with fatty acid, at least one hydroxyl group of the condensate. In the condensate A mentioned above, X contains at least one hydroxyl group, and thus the condensate A contains at least two hydroxyl groups. In the component (b), at least one hydroxyl group is capped with a fatty acid.

The carbon number of the dicarboxylic acid preferably ranges from 2 to 10, more preferably from 2 to 8. A dicarboxylic acid having more than 10 carbon atoms may not attain sufficiently durable liquid permeability of the fiber assembly. The dicarboxylic acid includes, for example, oxydipropionic acid, succinic acid, maleic acid, sebacic acid, phthalic acid, and the anhydrides of these dicarboxylic acids. For producing the condensate of the polyhydroxy ester and dicarboxylic acid, the ratio (molar ratio) of each raw material preferably ranges from 1:1 to 2:1, more preferably from 1.5:1 to 2:1. The esterification may be carried out under normal conditions with no specific restriction.

The number of carbon atoms contained in the fatty acid for capping at least one hydroxyl group of the condensate preferably ranges from 10 to 22, more preferably from 12 to 22. A fatty acid containing less than 10 carbon atoms increases the hydrophilicity, and a fatty acid containing more than 22 carbon atoms increases the hydrophobicity of the resultant agent. An agent with unbalanced hydrophilicity and hydrophobicity may not attain sufficient durable liquid permeability of the fiber assembly. The fatty acid includes, for example, lauric acid, myristic acid, palmitic acid, stearic acid, oleic acid, icosanoic acid, and behenic acid. For producing the ester of the condensate and the fatty acid, the ratio (molar ratio) between these materials preferably ranges from 1:0.2 to 1:1, more preferably from 1:0.4 to 1:0.8. The conditions for esterification are not specifically restricted.

The component (b) may be described as an ester of a dicarboxylic acid and an alkoxylated ricinoleic compound and/or its hydrogenated product, wherein at least one hydroxyl group of the ester is capped with a fatty acid. The dicarboxylic acid and fatty acid are those described above.

The examples of the alkoxylated ricinoleic compound are natural fats and oils such as castor oil, and their hydrogenated products such as hydrogenated castor oil.

The component (b) is often a mixture containing a number of components wherein the condensate A is contained as the major component. The condensate A is represented by the following formula (3).

[Formula 3]

(3)

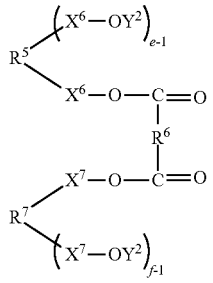

where $X^6$ and $X^7$ may be the same or different; $X^6$ is —O—CO—$R^8$—$(OA^2)_g$— or —$(OA^2)_g$; $X^7$ is O—CO—$R^9$—$(OA^2)_g$— or —$(OA^2)_g$—; $A^2$ in $X^6$ and $X^7$ is $C_{1-5}$ alkylene group, $A^2$ and g may be the same or different, g is 80 or less, and the total of g ranges from 10 to 80; $R^8$ is a residue obtained by removing a hydroxyl group and carboxyl group from a hydroxy fatty acid (HO—$R^8$—COOH, where the hydroxyl group may be bonded at the side chain or the terminal of $R^8$); $R^9$ is a residue obtained by removing a hydroxyl group and carboxyl group from a hydroxy fatty acid (HO—$R^9$—COOH, where the hydroxyl group may be bonded at the side chain or the terminal of $R^9$); $R^6$ is a divalent organic group; $R^5$ is a residue obtained by removing all of hydroxyl groups from a polyhydric alcohol ($R^5$ $(OH)_e$) where e ranges from 2 to 4; $R^7$ is a residue obtained by removing all of the hydroxyl groups from a polyhydric alcohol ($R^7$ $(OH)_f$) where f ranges from 2 to 4; $Y^2$ is —CO—$R^{10}$ where part of a plurality of $Y^2$ may be hydrogen atoms; and $R^{10}$ is a $C_{12-22}$ hydrocarbon group.

In the formula (3) mentioned above, $A^2$ includes, for example, ethylene group and propylene group, and one or more of the groups may be combined. The total of g preferably ranges from 5 to 30.

In the formula (3) mentioned above, the hydroxy fatty acid containing $R^8$ and $R^9$ includes ricinoleic acid, 12-hydroxy stearic acid, and salicylic acid, and ricinoleic acid and 12-hydroxy stearic acid are preferable.

In the formula (3) mentioned above, $R^6$ includes the divalent organic acids obtained by removing carboxyl groups (or acid-anhydride groups) from dicarboxylic acids such as oxydipropionic acid, succinic acid, maleic acid, sebacic acid, and phthalic acid, and the anhydrides of those dicarboxylic acids. Among those, the divalent organic acids obtained by removing carboxyl groups (or acid-anhydride groups) from succinic acid (anhydride) or maleic acid (anhydride) are preferable.

In the formula (3) mentioned above, the polyhydric alcohol containing $R^5$ includes ethylene glycol, glycerin, sorbitan, and trimethylol propane, and glycerin is preferable.

In the formula (3) mentioned above, $R^{10}$ includes monovalent hydrocarbon groups obtained by removing carboxyl groups from lauric acid, myristic acid, palmitic acid, stearic acid, oleic acid, icosanoic acid, or behenic acid, and one or more of monovalent hydrocarbons may be combined.

The preferable ratio of the component (b) in the hydrophilizing agent ranges from 10 to 40 wt. %, more preferably from 10 to 30 wt. %. The component (b) blended in the agent in a ratio less than 10 wt. % may result in insufficient durable liquid permeability of the fiber assembly, while the component (b) blended in the agent in a ratio above 40 wt. % may result in poor carding processability of the fiber and thus decrease fiber processing efficiency.

[Component (c)]

The component (c) is a dialkyl sulfosuccinate salt. The component (c) imparts superior initial liquid permeability to the fiber assembly for accelerating liquid permeation through the fiber assembly. The component (c), a dialkyl sulfosuccinate salt, is a dialkyl ester of succinic acid having a sulfonate salt group at the alpha position.

The component (c) preferably has a $C_{6-18}$ alkyl group, more preferably a $C_{8-18}$ alkyl group. An alkyl group having less than 6 carbon atoms may result in poor carding performance of the fiber, while an alkyl group having carbon atoms more than 18 may decrease the initial liquid permeability of the fiber assembly.

The sulfonate salt in the component (c) includes alkali metals salts such as sodium salts and potassium salts, and also includes amine salts. Sodium salts and/or potassium salts are preferable for accelerating liquid permeation through the fiber assembly treated with the hydrophilizing agent.

The ratio of the component (c) in the hydrophilizing agent preferably ranges from 1 to 40 wt. %, more preferably from 1 to 20 wt. %. The component (c) blended in the agent in a ratio below 1 wt. % may inhibit rapid liquid permeation through the fiber assembly, while the component (c) blended in a ratio more than 40 wt. % may result in poor carding performance of the fiber.

[Component (d)]

The component (d) is an alkylphosphate salt. The component (d) improves the carding performance of fiber and the durable liquid permeability of the fiber assembly, and decreases the amount of wet-back liquid.

The component (d) preferably has a $C_{6-22}$ alkyl group, and more preferably a $C_{8-18}$ alkyl group. An alkyl group having less than 6 carbon atoms may result in poor carding performance of the fiber, while an alkyl group having more than 22 carbon atoms may decrease both the initial liquid permeability and durable liquid permeability of the fiber assembly. The number of carbon atoms in the alkyl group may be variable, and the component (d) may be a mixture of two or more alkylphosphate salts.

The component (d) includes alkali metal salts such as sodium salts and potassium salts, and also includes $C_{1-9}$ amine salts and ammonium salts. Those salts are preferable for their high antistatic performance and easy handling.

The ratio of the component (d) in the hydrophilizing agent preferably ranges from 10 to 60 wt. %, more preferably from 15 to 55 wt. %. The component (d) blended in the agent in a ratio less than 10 wt. % may decrease the carding performance of the fiber, while the component (d) blended in the agent in a ratio more than 60 wt. % may decrease the durable liquid permeability of the fiber assembly.

For compensating the hydrophilicity of the alkylphosphate salt described above, a polyoxyalkylene alkylphosphate salt may be blended by 10 to 30 wt. % with the alkylphosphate salt.

[Component (e)]

The component (e) is at least one glycine derivative selected from the group consisting of trialkyl glycine derivatives and (alkylamide alkyl) dialkyl glycine derivatives. Component (e) improves durable liquid permeability of the fiber assembly.

The trialkyl glycine derivative is an inner salt of a carboxyl group and a quaternary ammonium in which three alkyl groups are bonded to the nitrogen atom of a glycine molecule, i.e., a compound having a so-called betaine structure. The alkyl groups in the trialkyl glycine are not specifically defined except that they should be $C_{1-22}$ alkyl groups. The trialkyl glycine derivatives include, for example, inner salts such as dimethyl dodecyl glycine hydroxide, dimethyl tetradecyl glycine hydroxide, dimethyl octadecyl glycine hydroxide, and β-hydroxy octadecyl dimethyl glycine hydroxide. Among those salts, preferable salts are trialkyl glycine derivatives having three alkyl groups, consisting of two lower alkyl groups such as methyl and ethyl groups and one long-chain alkyl group having 12 or more carbon atoms. Examples of such trialkyl glycine derivatives are dimethyl dodecyl glycine hydroxide, dimethyl tetradecyl glycine hydroxide, dimethyl hexadecyl glycine hydroxide, and dimethyl octadecyl glycine hydroxide.

The (alkylamide alkyl) dialkyl glycine derivatives include, for example, the compounds represented by the above formula (1). Among those compounds, a typical one is the compound in which the "b" in the formula (1) is equal to 1. The preferable compound is an (alkylamide alkyl) dialkyl glycine derivative represented by the formula (1) wherein the two alkyl groups represented by $R^2$ and $R^3$ are lower alkyl groups such as methyl and ethyl groups, and the alkylamide alkyl represented by $R^1$ is a long-chain alkyl group having 7 or more carbon atoms. Examples of such (alkylamide alkyl) dialkyl glycine derivatives are coco-fatty acid amide propyl betaine, lauric acid amide propyl betaine, and stearic acid amide ethyl betaine.

The ratio of the component (e) in the hydrophilizing agent preferably ranges from 10 to 40 wt. %, more preferably from 10 to 30 wt. %. A ratio of the component (e) lower than 10 wt. % may result in decreased durable liquid permeability of the fiber assembly, while a ratio of the component (e) greater than 40 wt. % may result in an increased amount of wet-back liquid and an decreased dry feel on the surface of the fiber assembly such as nonwoven fabric, though the ratio is advantageous for improved durable liquid permeability of the fiber assembly.

[Component (f)]

The component (f) is a polyoxyalkylene-modified silicone. The component (f) imparts superior durable liquid permeability to the fiber assembly and good processability in carding to the fiber.

The component (f) includes, for example, compound (4) represented by the following formula (4).

[Formula 4]

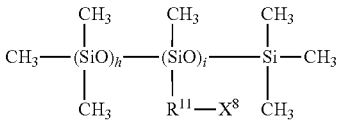

(4)

where $R^{11}$ is one selected from the group consisting of methylene group, propylene group, N-(aminoethyl) methyl imino group, and N-(aminopropyl) propyl imino group, $X^8$ is a polyoxyalkylene group, h and i are numbers selected from those such that Si constitutes 20 to 70 wt. % of the compound and the compound has a molecular weight ranging from 1,000 to 100,000.)

The Si content in the compound (4) (the wt. % of Si in the compound (4)) ranges from 20 to 70%. An Si content higher than 70% will decrease the stability of the hydrophilized fiber produced by applying the hydrophilizing agent of the present invention, and increase the production cost of the fiber. On the other hand, an Si content less than 20% may fail to attain durable liquid permeability of the fiber assembly.

The polyoxyalkylene group in the compound (4) includes, for example, polyoxyethylene groups, polyoxypropylene groups, polyoxybutylene groups, and groups obtained by copolymerizing two or more of the monomer variants forming those groups. The preferable ratio of polyoxyethylene groups in the total of the polyoxyalkylene groups is 20 wt. % or more, and a ratio lower than 20 wt. % may decrease liquid permeability of the fiber assembly.

The weight average molecular weight of the compound (4) is not specifically restricted, though the preferable molecular weight ranges from 1,000 to 100,000, more preferably from 2,000 to 80,000. A weight average molecular weight beyond the range of 1,000 to 100,000 results in decreased liquid permeability of the fiber assembly, especially in the case of a molecular weight below 1,000.

The preferable ratio of the component (f) in the hydrophilizing agent ranges from 1 to 20 wt. %, more preferably from 5 to 15 wt. %. A ratio of the component (f) less than 1 wt. % may fail to attain sufficient durable liquid permeability. On the other hand, a ratio of the component (f) higher than 20 wt. % may increase the amount of wet-back liquid and deposit generation in fiber production and nonwoven manufacturing processes, though the ratio improves durable liquid permeability of the fiber assembly.

[Other Components in the Hydrophilizing Agent]

The hydrophilizing agent of the present invention may be blended, optionally, with additives, i.e., an antistatic agent such as sodium alkane sulfonate salts, an amphoteric emulsifier such as N-alkyl sulfopyrolidone, a nonionic emulsifier, a lubricant such as carnauba wax, a defoamer, and an antiseptic. The ratios of those additives are not specifically restricted.

The hydrophilizing agent of the present invention is used to produce hydrophilized fibers by applying the agent to fiber in the manner described below. The hydrophilizing agent of the present invention may be added to fiber as an internal additive. In this case, the ratio of the agent to fiber polymer ranges from 2 to 30 wt. %, preferably from 3 to 15 wt. %. A ratio of the hydrophilizing agent less than 2 wt. % results in insufficient liquid permeability of fiber assembly, while a ratio of the hydrophilizing agent greater than 30 wt. % may decrease fiber tenacity leading to greatly decreased fiber production efficiency.

[Hydrophilized Fiber]

The hydrophilized fiber of the present invention comprises fiber and the hydrophilizing agent mentioned above.

The ratio of the hydrophilizing agent to be applied to fiber ranges from 0.1 to 2 wt. % of the hydrophilized fiber mentioned above, preferably from 0.3 to 1 wt. %. A ratio of the hydrophilizing agent to the hydrophilized fiber below 0.1 wt. % may result in a high amount of wet-back liquid and decreased durability of the liquid permeability of the fiber assembly. On the other hand, a ratio of the hydrophilizing agent greater than 2 wt. % may result in frequent fiber wrapping in the carding of the fiber, leading to greatly decreased fiber processing efficiency, and increased wet feel of fiber products such as nonwoven fabrics after liquid permeation.

The fiber include, for example, single-component fibers including (fibrillated) polyolefin fiber, polyester fiber, nylon fiber, and vinyl chloride fiber; and thermo-bondable composite fibers including sheath-core structural fibers such as polyethylene-polyester composite fiber, polyethylene-polypropylene composite fiber, polypropylene-copolypropylene composite fiber, polypropylene-copolyester composite fiber, and copolyester-copolyester composite fiber. The structure of fiber assembly is not specifically restricted, and filament yarns, spun yarns, and their composites or products (for example, spun-bonded, spunlaced, or melt brown nonwoven fabrics or webs), or final products such as underwear may be applicable.

The hydrophilizing agent of the present invention may be applied to fiber neat without diluting, or may be applied in the form of an emulsion of 1 to 30 wt. % concentration prepared by diluting the agent with water or in a diluted form of 1 to 30 wt. % concentration prepared by diluting the agent with a low-viscosity hydrocarbon.

The application means for applying the hydrophilizing agent of the present invention to fiber is not specifically restricted, and kiss rollers, spraying nozzles, or bath immersion may be employed.

[Properties of Hydrophilized Fiber]

The hydrophilized fiber of the present invention have properties which excel at preventing wet back. The amount of wet-back liquid through the hydrophilized fiber assembly is normally 1.2 g or less, preferably 1.0 g or less, more preferably 0.8 g or less, further preferably 0.6 g or less, more further preferably 0.4 g, and most preferably 0.2 g or less. The procedure for determining the amount of wet-back liquid is described in detail in the examples.

The hydrophilized fiber of the present invention attains excellent durable liquid permeability of the fiber assembly with minimum time-dependent deterioration. The durable liquid permeability of the hydrophilized fiber assembly was evaluated as described in detail in the examples. In the third determination, the time required for physiological saline solution to disappear was checked at 20 points on a fiber assembly. The number of points where the physiological saline solution disappears within 5 seconds is normally 10 or more, preferably 12 or more, more preferably 14 or more, further preferably 16 or more, more further preferably 18 or more, and most preferably 20. Hydrophilized fiber assembly having durable liquid permeability with minimum time-dependent deterioration means a fiber assembly exhibiting excellent durable liquid permeability before being subjected to aging, and exhibiting minimum change in the liquid permeability after being subjected to aging. A fiber assembly with less change in durable liquid permeability is more preferable.

The properties mentioned above are obtained by applying the hydrophilizing agent of the present invention to fiber.

Effects and Advantages of the Invention

The hydrophilizing agent of the present invention functions to decrease the amount of wet-back liquid without modifying the structure of absorbent articles, and attains excellent and durable liquid permeability in a fiber assembly. The hydrophilizing agent imparts good antistaticity to fiber in order to prevent static trouble at low humidity, and sufficient lubricity in order to improve the processability of the fiber in carding.

The hydrophilized fiber of the present invention functions to decrease the amount of wet-back liquid and to achieve excellent and durable liquid permeability of the fiber assembly owing to the above-mentioned hydrophilizing agent applied to the fiber. The good antistaticity of the hydrophilizing agent applied to the hydrophilized fiber prevents static trouble even at low humidity during the production and processing of the fiber. The hydrophilized fiber exhibits high processability in carding because the hydrophilizing agent imparts sufficient lubricity and improved separatability to the fiber.

DETAILED DESCRIPTION OF THE PREFERRED EMBODIMENTS

The present invention is further described with the following examples, though the present invention is not restricted within the scope of those examples. The tested properties and their testing procedures in the examples and comparative examples are described below. In the following description, "%" represents "weight percent".

EXAMPLES 1 TO 7 AND COMPARATIVE EXAMPLES 1 TO 9

The components shown in Tables 1 and 3 were mixed in order to be prepared into the hydrophilizing agents (1) to (7) and the comparative hydrophilizing agents (1) to (9). The ratio (wt. %) of those components are shown in Tables 1 and 3. Each of the resultant hydrophilizing agents was diluted with water at about 60 degrees C. to be prepared into a dilution containing 1% of an agent. Then 50 g of each dilution was sprayed to 100 g of fiber. The fiber was a polyethylene-polypropylene sheath-core composite fiber (1.5 dtex, 38 mm) free from any fiber treating agents including a hydrophilizing agent. The fiber samples treated with each dilution were placed in an oven at 60 degrees C. for 2 hours, and then air-dried at room temperature for over 8 hours to be prepared into hydrophilized fibers.

Each of the prepared hydrophilized fibers was processed by beating and carding with a test carding machine in order to be converted into a web of 30 g/m$^2$ density. In the carding, the carding performance (processability in carding represented by fiber wrapping on a card cylinder and antistaticity) of each of the hydrophilized fibers was evaluated in the procedures described below. The results are shown in Tables 2 and 4. Then each web obtained in the carding was heated in an air-through convection oven at 130 degrees C. to be fixed into nonwoven fabric. The nonwoven fabric was then tested in the procedures described below to evaluate its properties (initial liquid permeability, durable liquid permeability, and the amount of wet-back liquid). The results are shown in Tables 2 and 4.

[Testing Procedure]

(1) Fiber Wrapping on Card Cylinder 40 g of a staple fiber sample processed by beating was fed to a test carding machine be processed at 30 degrees C. and 70% R.H. After carding, the cylinder of the carding machine was visually inspected and evaluated according to the standard described below, where the grade 5 is the best.

5: no fiber wrapping on the cylinder 4: fiber wrapped on 1/10 surface area of the cylinder 3: fiber wrapped on 1/5 surface area of the cylinder 2: fiber wrapped on 1/3 surface area of the cylinder 1: fiber wrapped on the whole surface area of the cylinder (2) Antistaticity 40 g of a staple fiber sample processed by beating was processed into a web with a test carding machine at 20 degrees C. and 45% R.H. The static charge generated on the web was determined, and evaluated according to the standard described below, where the grade 5 is the best. Fiber with a static charge below 100 V can be fed to actual processes.

5: below 50 v 4: 0.5 to 1.0 kv 3: 1.0 to 1.5 kv 2: 1.5 to 2.0 kv 1: higher than 2.0 kv (3) Initial Liquid Permeability of Nonwoven Fabric A sheet of nonwoven fabric was placed on a sheet of filter paper (No. 5, supplied by Toyo Roshi Kaisha Ltd.), and one drop (about 0.05 ml) of physiological saline solution was placed onto the nonwoven fabric surface from a burette fixed 10 mm above the nonwoven fabric surface. The time required for the drop to disappear was checked. The same testing was carried out at 20 points on the nonwoven fabric surface, and the number of points where the drops disappeared within 5 seconds was recorded. A nonwoven fabric on which the drops disappeared within 5 seconds at 18 points or more is evaluated to have good initial liquid permeability.

(4) Durable Liquid Permeability of Nonwoven Fabric

A 10-cm square piece of nonwoven fabric was placed on a commercially available disposable diaper, and a pipe having a 60-mm internal diameter was stood on the nonwoven fabric. 80 ml of physiological saline solution was poured into the pipe and the solution was allowed to be absorbed in the disposable diaper through the nonwoven fabric. After pouring the solution, the setting was left for 3 minutes. Then the nonwoven fabric was taken off and enclosed between two sheets of filter paper (No. 5, supplied by Toyo Roshi). Then a 10-cm square plate and a weight, having a total weight of 3.5 kg, were placed on the layered filter paper and nonwoven fabric for 3 minutes in order to dehydrate the nonwoven fabric. Then the nonwoven fabric was air-dried at room temperature for 5 minutes. After the drying, the area of the nonwoven fabric through which the physiological saline solution in the pipe had permeated was tested in the procedure for evaluating the initial liquid permeability of nonwoven fabric at 20 points. The number of points where a drop disappeared within 5 seconds was recorded. The number of points equal to or more than 18 represents good durable liquid permeability of the tested nonwoven fabric. The nonwoven fabrics were tested in the same procedure repeatedly. A greater number of points where a drop of physiological saline solution disappeared within 5 seconds after repeated testing represents more durable liquid permeability of the nonwoven fabric.

(5) Liquid Permeability after Aging

The 10-cm square piece of nonwoven fabric mentioned above was placed in an incubator at 40 degrees C. and 70% R.H. for 30 days. After 30 days, the nonwoven fabric was taken out and the initial liquid permeability and durable liquid permeability of the nonwoven fabric were tested in the same manner as mentioned above. A nonwoven fabric which shows a smaller difference in its initial liquid permeability and durable liquid permeability before and after the aging is evaluated to have a liquid permeability more durable against time-dependent deterioration, and a smaller difference is evaluated to be more preferable.

(6) Amount of Wet Back Liquid

A 10-cm square of a nonwoven fabric was placed on a commercially available disposable diaper, and a pipe having 60-mm internal diameter was stood on the nonwoven fabric. Then 100 ml of physiological saline solution was poured into the pipe, and the solution was allowed to be absorbed in the disposable diaper through the nonwoven fabric. After all of the physiological saline solution was absorbed in the disposable diaper, the pipe was removed, and 20 sheets of filter paper (No. 5, supplied by Toyo Roshi) weighed prior to that were placed on the nonwoven fabric. A 5-kg weight was placed on the filter paper. After 5 minutes, the 20 sheets of filter paper were weighed, and the increased weight of the filter paper was determined as the amount (g) of wet-back liquid. The preferable amount of the wet-back liquid is 1.0 g or less, though the allowable limit is 1.2 g.

TABLE 1

| Component | Examples 1 | 2 | 3 | 4 | 5 | 6 | 7 |
|---|---|---|---|---|---|---|---|
| Component a | 20 | 15 | 20 | 20 | 20 | 20 | 20 |
| Component b | 15 | 20 | 25 | 10 | 20 | 15 | 15 |
| Component c | 10 | 5 | 5 | 15 | 10 | 15 | 15 |
| Component d | 30 | 25 | 20 | 30 | 30 | 25 | 30 |
| Component e | 15 | 15 | 15 | 15 | 10 | 15 | 10 |
| Component f1 | — | — | — | — | — | — | — |
| Component f2 | — | — | — | — | — | 10 | — |
| Component f3 | 10 | 20 | 15 | 10 | — | — | 10 |
| Component f4 | — | — | — | — | 10 | — | — |

unit: wt. %

Component a: a cationized compound produced by reacting polyoxyethylene behenic acid diethylene triamine and epichlorohydrin (having polyoxyethylene groups containing 15 ethylene oxide units in total)
Component b: an ester of polyoxyethylene castor wax, maleic acid, and stearic acid (having polyoxyethylene groups containing 20 ethylene oxide units in total)
Component c: sodium dioctyl sulfosuccinate salt Component d: potassium stearyl phosphate salt Component e: dimethyl octadecyl glycine hydroxide Component f2: polyoxyethylene-polyoxypropylene-modified silicone (Si content: 35%, POE content: 60%, M.W.: 7000)
Component f3: polyoxyethylene-polyoxypropylene-modified silicone (Si content: 65%. POE content: 100%, M.W.: 10000)
Component f4: polyoxyethylene-polyoxypropylene-modified silicone (Si content: 70%, POE content: 80%, M.W.: 55000)

The POE content represents the ratio (wt. %) of polyoxyethylene in polyoxyalkylene.

TABLE 2

| Tested property | | Examples 1 | 2 | 3 | 4 | 5 | 6 | 7 |
|---|---|---|---|---|---|---|---|---|
| Processability in carding | | | | | | | | |
| Fiber wrapping on cylinder | | 5 | 5 | 5 | 5 | 5 | 5 | 5 |
| Antistaticity | | 5 | 5 | 5 | 5 | 5 | 5 | 5 |
| Properties of nonwoven fabric Before aging | | | | | | | | |
| Initial liquid permeability | | 20 | 20 | 20 | 20 | 20 | 20 | 20 |
| Durable liquid permeability | 1st | 20 | 20 | 20 | 20 | 20 | 20 | 20 |
| | 2nd | 20 | 20 | 20 | 20 | 20 | 20 | 20 |

TABLE 2-continued

| Tested property | | Examples 1 | 2 | 3 | 4 | 5 | 6 | 7 |
|---|---|---|---|---|---|---|---|---|
| | 3rd | 16 | 16 | 18 | 10 | 12 | 14 | 16 |
| | 4th | 10 | 12 | 12 | 6 | 8 | 10 | 14 |
| | 5th | 3 | 5 | 10 | 0 | 4 | 8 | 8 |
| Wet back (g) | | 0.5 | 0.4 | 0.3 | 0.2 | 0.3 | 0.4 | 0.5 |
| After aging | | | | | | | | |
| Initial liquid permeability | | 20 | 20 | 20 | 20 | 20 | 20 | 20 |
| Durable liquid permeability | 1st | 20 | 20 | 20 | 20 | 20 | 20 | 20 |
| | 2nd | 17 | 18 | 20 | 18 | 20 | 19 | 20 |
| | 3rd | 10 | 15 | 17 | 10 | 11 | 13 | 13 |
| | 4th | 2 | 10 | 11 | 5 | 7 | 12 | 12 |
| | 5th | 0 | 4 | 5 | 0 | 3 | 4 | 3 |

TABLE 3

| Component | Comparative examples 1 | 2 | 3 | 4 | 5 | 6 | 7 | 8 | 9 |
|---|---|---|---|---|---|---|---|---|---|
| Component a | — | 15 | 5 | 50 | 40 | 15 | 10 | — | — |
| Component b | 25 | — | 5 | 15 | 15 | 40 | 10 | — | 20 |
| Component c | 25 | 5 | 10 | 10 | 20 | 10 | 10 | — | — |
| Component d | 20 | 35 | 60 | 15 | 15 | 5 | 20 | — | — |
| Component e | 15 | 25 | 10 | 5 | — | 20 | 50 | 20 | 10 |
| Component f1 | — | — | — | — | 10 | — | — | — | — |
| Component f2 | — | — | — | — | — | — | — | — | — |
| Component f3 | 15 | 20 | 10 | 5 | — | — | — | 10 | 10 |
| Component f4 | — | — | — | — | — | 10 | — | — | — |
| Component g | — | — | — | — | — | — | — | 40 | — |
| Component h | — | — | — | — | — | — | — | 10 | — |
| Component i | — | — | — | — | — | — | — | 20 | 60 |

unit: wt. %

The components (a) to (e) and the components f3 and f4 in Table 3 are the same as those in Table 1.
Component f1: polyoxyethylene-polyoxypropylene-modified silicone (Si content: 15%, POE content: 50%, M.W.: 2000)
Component g: a polyoxyethylene behenic acid diethanol amide (having polyoxyethylene groups containing 15 ethylene oxide units in total)
Component h: a cationized compound produced by reacting stearic acid diethanol amide and epichlorohydrin
Component i: potassium lauryl phosphate salt

TABLE 4

| Tested property | | Comparative examples 1 | 2 | 3 | 4 | 5 | 6 | 7 | 8 | 9 |
|---|---|---|---|---|---|---|---|---|---|---|
| Processability in carding | | | | | | | | | | |
| Fiber wrapping on cylinder | | 5 | 5 | 5 | 5 | 5 | 3 | 4 | 5 | 5 |
| Antistaticity | | 5 | 5 | 5 | 5 | 5 | 3 | 5 | 5 | 5 |
| Property of nonwoven fabric Before aging | | | | | | | | | | |
| Initial liquid permeability | | 20 | 20 | 20 | 20 | 20 | 20 | 20 | 20 | 20 |
| Durable liquid permeability | 1st | 20 | 20 | 16 | 10 | 8 | 20 | 20 | 20 | 20 |
| | 2nd | 14 | 16 | 8 | 5 | 0 | 10 | 20 | 20 | 20 |
| | 3rd | 8 | 6 | 0 | 0 | 0 | 5 | 10 | 16 | 14 |
| | 4th | 0 | 0 | 0 | 0 | 0 | 0 | 0 | 8 | 9 |
| | 5th | 0 | 0 | 0 | 0 | 0 | 0 | 0 | 1 | 1 |
| Wet back (g) | | 1.1 | 0.9 | 0.8 | 0.7 | 1.2 | 1.5 | 1.7 | 0.8 | 0.9 |
| After aging | | | | | | | | | | |
| Initial liquid permeability | | 20 | 20 | 20 | 20 | 20 | 20 | 20 | 20 | 20 |
| Durable liquid permeability | 1st | 20 | 20 | 20 | 20 | 20 | 20 | 20 | 20 | 17 |
| | 2nd | 10 | 12 | 6 | 4 | 0 | 6 | 13 | 13 | 10 |
| | 3rd | 3 | 2 | 0 | 0 | 0 | 1 | 3 | 3 | 0 |

TABLE 4-continued

| Tested property | Comparative examples 1 | 2 | 3 | 4 | 5 | 6 | 7 | 8 | 9 |
|---|---|---|---|---|---|---|---|---|---|
| 4th | 0 | 0 | 0 | 0 | 0 | 0 | 0 | 0 | 0 |
| 5th | 0 | 0 | 0 | 0 | 0 | 0 | 0 | 0 | 0 |

Various details of the invention may be changed without departing from its spirit nor its scope. Furthermore, the foregoing description of the preferred embodiments according to the present invention is provided for the purpose of illustration only, and not for the purpose of limiting the invention as defined by the appended claims and their equivalents.

What is claimed is:

1. A hydrophilizing agent comprising:

(a) a cationized compound of a (poly) amine having a polyoxyalkylene group and an acyl group;

represented by the following Formula 2:

[Formula 2]

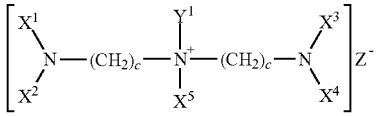

where c is an integer ranging from 2 to 4; each of $X^1$ to $X^4$ is a hydrogen atom, $R^4CO$— ($R^4$ being a $C_{15-27}$ hydrocarbon group), or $-(A^1O)_d$—H ($A^1$ being a $C_{1-5}$ alkylene group, and d being an integer ranging from 2 to 20), $X^5$ is $R^4CO$— or $-(A^1O)_d$—H, provided that at least one of $X^1$ to $X^5$ is each $R^4CO$— and $-(A^1O)_d$—H, and each of $X^1$ and $X^2$, or each of $X^3$ and $X^4$ is not simultaneously a $R^4CO$—; a plurality of $-(A^1O)_d$—H need not always contain the same number of alkylene oxide units and the total number of the alkylene oxide units ranges from 2 to 20; and $Y^1$ and Z are groups derived from an alkylating agent (Y1-Z), the alkylating reagent being at least one compound selected from the group consisting of methyl chloride, methyl bromide, benzyl chloride, long chain alkyl chloride, epichlorohydrin, dimethyl sulfate, diethyl sulfate and trimethyl phosphate (b) an ester prepared by capping, with a fatty acid, at least one hydroxyl group in a condensate of a dicarboxylic acid and a hydroxy fatty acid polyhydric alcohol ester containing a polyoxyalkylene group;

(c) a dialkyl sulfosuccinate salt;

(d) an alkylphosphate salt;

(e) at least one glycine derivative selected from the group consisting of trialkyl glycine derivatives and (alkylamide alkyl) dialkyl glycine derivatives; and (f) a polyoxyalkylene-modified silicone; wherein the component (a) constitutes 10 to 40 wt. %, the component (b) constitutes 10 to 40 wt. %, the component (c) constitutes 1 to 40 wt. %, the component (d) constitutes 10 to 60 wt. %, the component (e) constitutes 10 to 40 wt. %, and the component (f) constitutes 1 to 20 wt. % of the total amount of said hydrophilizing agent.

2. A hydrophilizing agent according to claim 1, wherein said hydroxy fatty acid polyhydric alcohol ester containing a polyoxyalkylene group in the component (b) is an alkylene-oxide adduct of an ester of a $C_{6-22}$ hydroxy fatty acid and a polyhydric alcohol, said dicarboxylic acid in the component (b) contains 2 to 10 carbon atoms, and said fatty acid contains 10 to 22 carbon atoms.

3. A hydrophilizing agent according to claim 1, wherein the component (c) contains a $C_{6-18}$ alkyl group, and is a sodium salt and/or a potassium salt.

4. A hydrophilizing agent according to claim 1, wherein the component (d) contains a $C_{6-22}$ alkyl group, and is at least one salt selected from the group consisting of potassium salts, sodium salts, $C_{1-9}$ alkyl amine salts, and ammonium salts.

5. A hydrophilizing agent according to claim 1, wherein the component (e) is a compound represented by the following Formula 1:

[Formula 1]

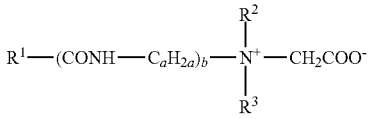

where $R^1$ is a $C_{7-22}$ hydrocarbon group, a is an integer ranging from 1 to 3, b is 0 or 1, and $R^2$ and $R^3$ are $C_{1-3}$ hydrocarbon groups.

6. A hydrophilizing agent according to claim 1, wherein the molecular weight of the component (f) ranges from 1,000 to 100,000, and polyoxyethylene constitutes at least 20 wt. % of said polyoxyalkylene in the component (f).

7. A hydrophilizing agent according to claim 1, wherein the total number of alkylene oxide units forming the polyoxyalkylene group in the component (a) ranges from 15 to 20.

* * * * *